United States Patent [19]

Moss

[11] 4,091,912

[45] May 30, 1978

[54] RECORD MEDIA CLAMPING MECHANISM

[75] Inventor: James R. Moss, Lum, Mich.

[73] Assignee: Computer Peripherals, Inc., Rochester, Mich.

[21] Appl. No.: 778,766

[22] Filed: Mar. 17, 1977

[51] Int. Cl.[2] ..... B41J 15/00

[52] U.S. Cl. ..... 400/146 R; 269/132; 226/59; 226/151; 400/616.1; 400/618; 400/619; 400/645

[58] Field of Search ..... 197/107, 133 R; 226/59, 226/60, 151, 147, 195; 269/131, 132

[56] References Cited

U.S. PATENT DOCUMENTS

| | | | |
|---|---|---|---|
| 3,516,529 | 6/1970 | Shurtliff | 197/107 |
| 3,568,812 | 3/1971 | Eitel | 197/133 R |
| 3,584,860 | 6/1971 | Ervin | 269/131 |
| 3,586,149 | 6/1971 | Miller | 197/133 R |
| 3,732,810 | 5/1973 | Skiba et al. | 197/133 R |
| 3,768,716 | 10/1973 | Bastiaans | 226/195 |

FOREIGN PATENT DOCUMENTS

| | | | |
|---|---|---|---|
| 1,052,696 | 12/1966 | United Kingdom | 197/107 |

*Primary Examiner*—William Pieprz
*Attorney, Agent, or Firm*—J. T. Cavender; Wilbert Hawk, Jr.; George J. Muckenthaler

[57] ABSTRACT

A plurality of clamping members are disposed along a recording line against the record media, and a cable, secured at the ends thereof, is trained in a path engaged with the clamping members and with movable bearing members spaced between the clamping members. Actuation of a solenoid causes a rocker arm to pivot and through a cable tension control member carried thereby cause tightening of the cables on the clamping members and on the bearing elements thereby changing the force on the clamping members and against the record media for holding the media in precise position while recording thereon.

17 Claims, 9 Drawing Figures

FIG. 6
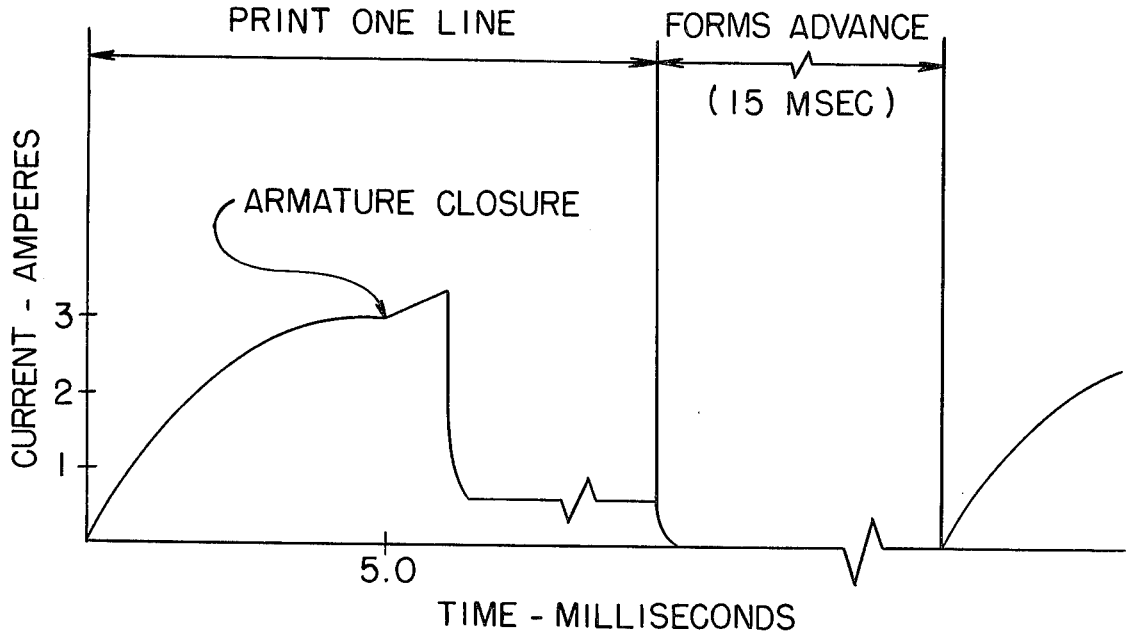
FIG. 7
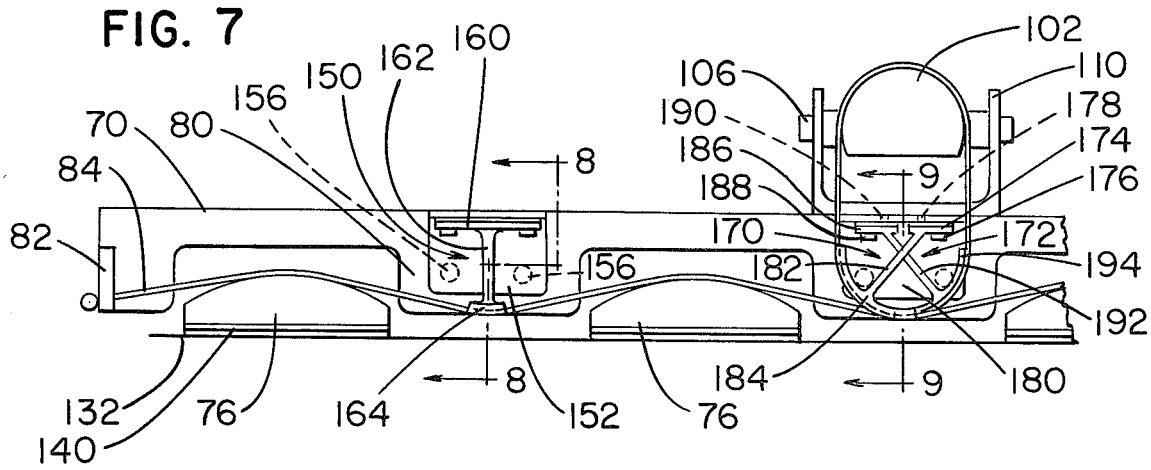
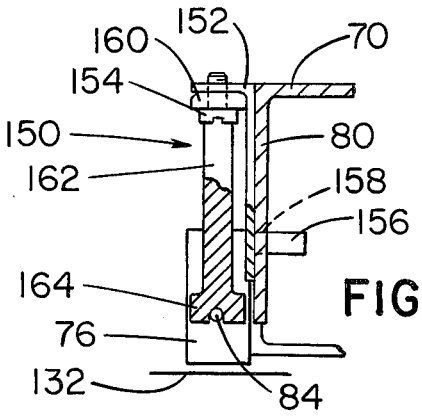
FIG. 8
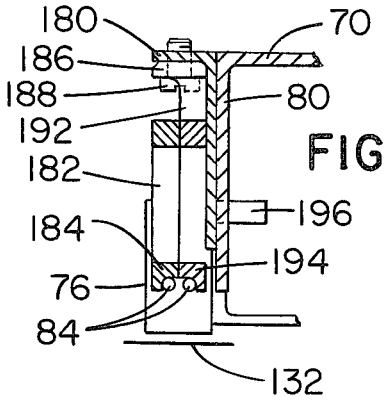
FIG. 9

RECORD MEDIA CLAMPING MECHANISM

BACKGROUND OF THE INVENTION

In high speed printers of the impact type, it is necessary that the record media or paper be maintained in a taut or tensioned condition during the printing operation. As is well known, the paper, in a drum type printer, has a tendency to be moved in the direction of rotation of the drum by reason of the contact of the paper therewith. Likewise, in a band printer, there is a tendency to move the paper in a horizontal direction by reason of the rotation of the band in such direction past the printing station. In the case of a line printer, wherein printing is performed or accomplished a full line at a time, the paper is caused to be incrementally advanced after each and every line of printing. During the time of paper advancement, such paper, although taut and under tension, should be freely movable past the printing station. However, at the time of printing the line, the paper must be held stationary so as to effect a precise line of print upon impact of the hammers against the type characters, whether such characters are on the surface of a rotating drum or on the surface of a moving type band.

Representative prior art in controlling the paper in high speed printers or the like and maintaining the paper in a desired position at the moment of printing include the following patents. U.S. Pat. No. 3,259,288, issued on July 5, 1966 to C. I. Wassermann, shows vacuum tensioning of paper in a high speed printer wherein a chamber has a plurality of port holes provided with adjustable shutters and the vacuum in the chamber is produced by a fan. U.S. Pat. No. 3,550,745, issued on Dec. 29, 1970 to D. Bisone et al., shows a paper arresting device for high speed printers wherein a series of electromagnets are disposed across one side of the paper and cooperating armatures are disposed on the other side for clamping the paper while printing. U.S. Pat. No. 3,568,812, issued on Mar. 9, 1971 to R. J. F. Eitel, discloses a holdback device for controlling the flow of a unit of paper in a high speed line printer wherein a blade or pawl is movably mounted in contact with the paper web and bearing on a fixed surface. The blade or pawl grips the web between it and a drum on the other side of the web. U.S. Pat. No. 3,586,149, issued on June 22, 1971 to R. H. Miller, discloses web tensioning apparatus comprised of a series of elliptical springs mounted on a rotatable rod on one side of the web and a backup bar mounted on a resilient pad adjacent the other side of the web. U.S. Pat. No. 3,799,314, issued on Mar. 26, 1974 to J. E. Smith, shows a platen brake wherein a rod is rotatably mounted adjacent the platen and the form tends to rotate the platen clockwise while the rod, also rotated clockwise by the form, tends to rotate the platen counterclockwise and causes the platen to stop upon stopping the form feed. And, U.S. Pat. No. 3,802,546, issued on Apr. 9, 1974 to C. J. Helms, shows web clamping apparatus comprising a flat coil structure supported by a plurality of flexure members. A permanent magnet is perpendicular to the plane of the coil and a force is produced which acts to move the coil forward to clamp the web against a pressure plate.

SUMMARY OF THE INVENTION

The present invention relates to paper clamping mechanism in a high speed line printer and more particularly to a paper clamp assembly comprised of a plurality of spaced clamp members mounted on resilient supports with movable bearing elements positioned between the clamp members and a cable trained around and engaged with the clamp members and with the bearing elements. The cable is secured at one end thereof and is trained in a path along and against the clamp members and around the bearing elements, the cable being adjustably secured at the other end thereof. A solenoid is actuated to pivot a rocker arm, which action moves a cable tension control member in a direction away from the normal direction of urging of the clamping members and causes tightening of or a tendency to straighten the cable along its path and to increase the forces on the clamping members and against the paper to thereby hold the paper in a precise position against a platen or like backup member at the time of impact of the printing hammers against the characters on the type band. The bearing elements, in one embodiment, comprise rotatable pulleys around which the cable is trained, and in another embodiment, comprise arcuate elements which move a slight amount by reason of flexing of the supporting arms therefor.

In view of the above discussion, the principal object of the present invention is to provide means for holding the paper in precise position at the time of printing.

Another object of the present invention is to provide means for adjusting the pressure or force against the printing paper at the time of paper advancement and at the time of printing.

An additional object of the present invention is to provide paper clamping apparatus utilizing clamping members engageable with the paper at all times and wherein the clamping force is changed at the time of printing.

A further object of the present invention is to provide paper clamping mechanism including an elongated member of sinuous nature which is acted upon by pivotable means to increase tension in said elongated member at the time of printing.

Additional advantages and features of the present invention will become apparent and fully understood from a reading of the following description taken together with the annexed drawings, in which:

FIG. 6 is a graphic showing of clamp solenoid operation during a printer cycle of operation;

FIG. 7 is a partial top plan view, enlarged from the plan view of FIG. 3, and showing a modification of the clamping mechanism;

FIG. 8 is a side elevational view taken on the plane 8—8 of FIG. 7; and

FIG. 9 is a side elevational view taken on the plane 9—9 of FIG. 7.

Figure 1:
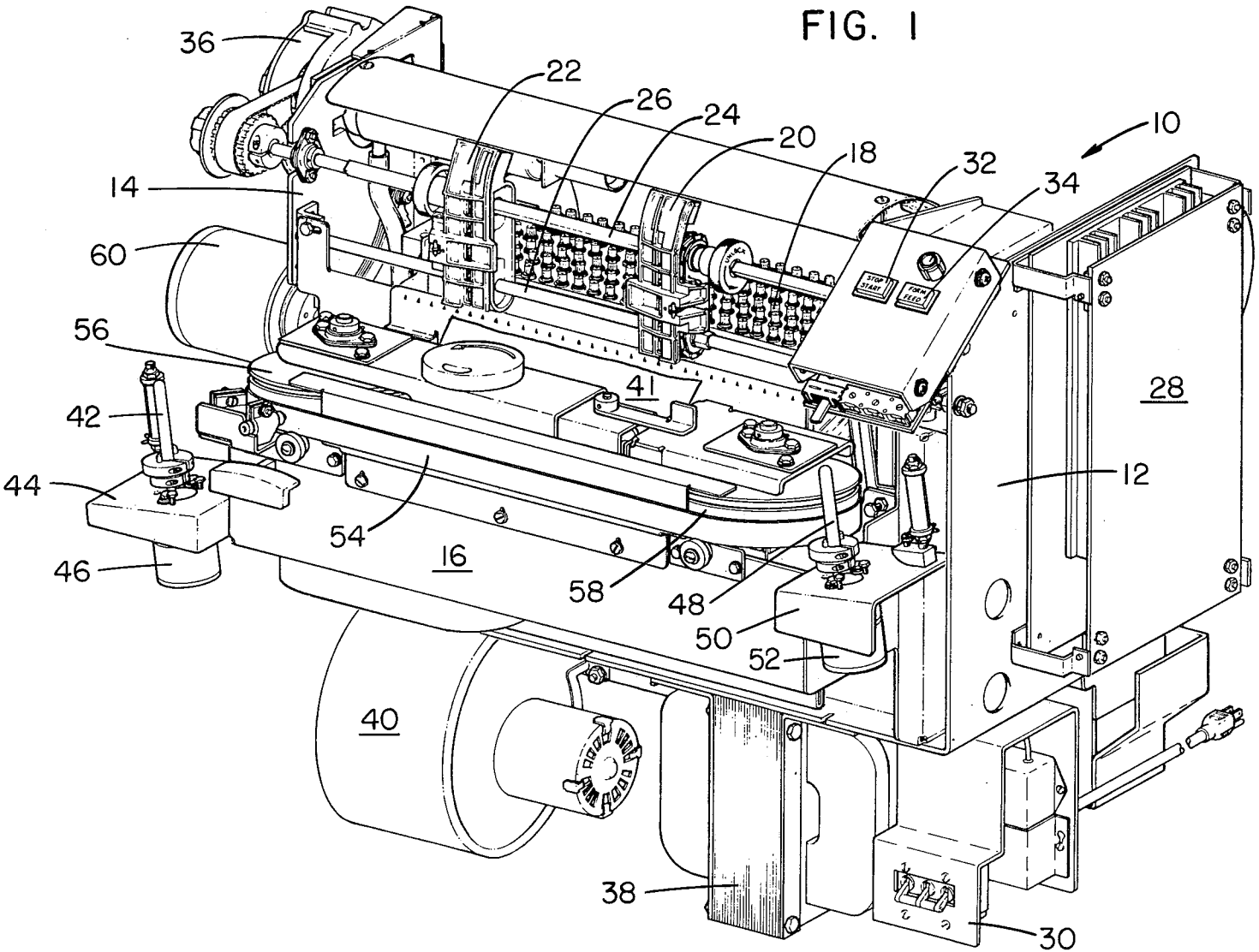
FIG. 1 is a perspective view of a portion of a printer incorporating the subject matter of the present invention.

As seen in FIG. 1, a printer 10 incorporating the subject matter of the present invention utilizes a band for carrying the type characters thereon, such band printer distinguishing from a drum printer in a number of areas and features, the most significant area being the type carrying structure. The printer 10 includes the usual framework of vertical side plates 12 and 14, which support the print band gate structure 16, the hammer bank 18, the paper forms tractors 20 and 22 carried on shafts 24 and 26, the power supply and servo drive 28, and other major parts of the printer which will be explained later in further detail. An on-off switch 30 is located at the lower right front of the printer, a start-stop switch 32 and a forms feed switch 34 are positioned on the top right front of the printer, and forms handling control mechanism 36 is located on the upper left side of the printer 10. A transformer 38 and a blower unit 40 are disposed under the gate structure 16, the blower unit providing cooling to the various areas and parts of the printer.

Form paper or like record media 41 is caused to be driven or pulled by the tractors 20, 22 from a forms stack below the gate structure 16, upwardly past the printing station between a type band 54 and the hammer bank 18, and out an exit slot at the rear of the printer. A ribbon (not shown in FIG. 1) is caused to be driven from a ribbon spool rotatable on a spindle 42 which is supported on a frame member 44 and driven by a motor 46 at the left side of the gate structure 16, the ribbon being guided in a path rearward of the gate structure and onto a ribbon spool rotatable on a further spindle 48 which is supported on a frame member 50 and driven by a motor 52 at the right side of the gate structure.

The print or type band 54 is caused to be driven in a counter-clockwise direction by the drive pulley 56, at the left side of the gate structure 16, and around a driven or idler pulley 58 located at the right side of the structure 16, the band 54 being directed in a path adjacent a platen (not shown in FIG. 1) and past a print station and positioned to be impacted by print hammers aligned in a horizontal manner forward of the hammer bank 18. A hammer bank drive motor 60 is provided for driving or moving the hammer bank in a horizontal direction for purposes not relevant to the subject matter of the present invention.

For purposes of information, the print band support mechanism, the forms handling control mechanism, and the tracking mechanism for the inking ribbon include structures which are the subject matter of copending applications, assigned to the same assignee as the present application.

Figure 2:
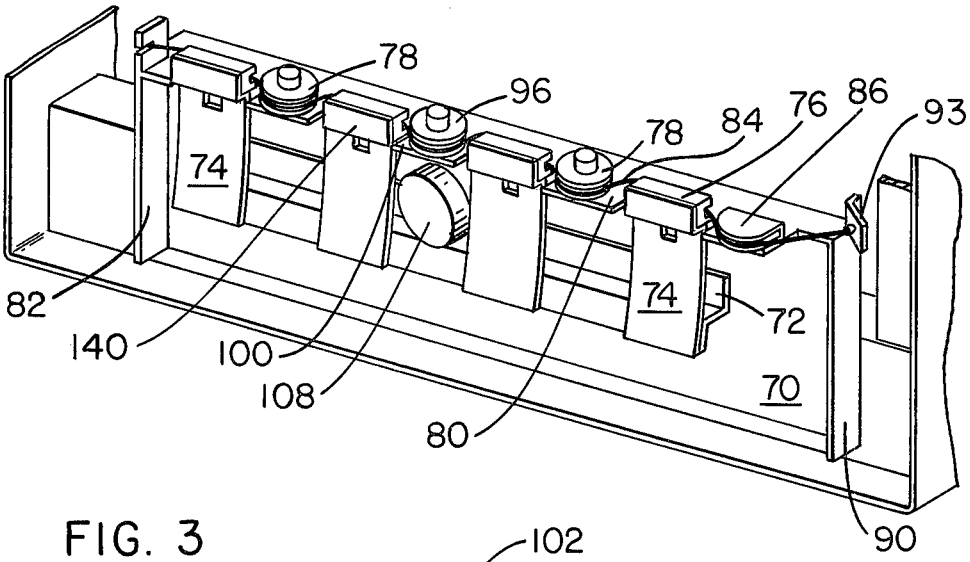
FIG. 2 is a perspective view of a portion of the printer shown in FIG. 1 and illustrating the paper clamping mechanism.

FIG. 2 shows a portion of the printer, the gate structure being omitted for purposes of illustrating the clamping mechanism of the present invention. As illustrated (see also FIG. 3), a frame member 70 supports the various elements of the mechanism which include a Z-shaped member 72 to which are secured a plurality of upstanding plate members 74 for carrying respective paper clamp members 76 in the form of longitudinal blocks aligned in a position adjacent the print station. Interspersed between the clamp members 76 are bearing members or pulleys 78 journaled on pins supported from an angle member 80 of the frame member 70, it being seen that three pulleys accommodate four clamp members, two of the pulleys being identical and the third pulley differing therefrom, as will be further described. An upstanding side member 82 of the frame member 70 is provided for having securing thereto one end of a flexible steel cable 84, such cable being trained in engageable position in a groove of each of the clamp members 76 and partially trained around each of the pulleys 78, then around a guide member 86, and secured to an upstanding side member 90 of the frame member 70. The right hand end of the cable 84 (FIGS. 2 and 3) includes a threaded ferrule 92 (FIG. 3) secured thereto and a nut 94 on the ferrule operating against a bracket 93 on side member 90 (FIG. 2) for adjusting the tension in the cable. A different tension adjusting arrangement may include an upright block member on the angle member 80 and having a curved slot in the block member for the cable 84 with a nut atop the block to adjust the cable.

Figure 3:
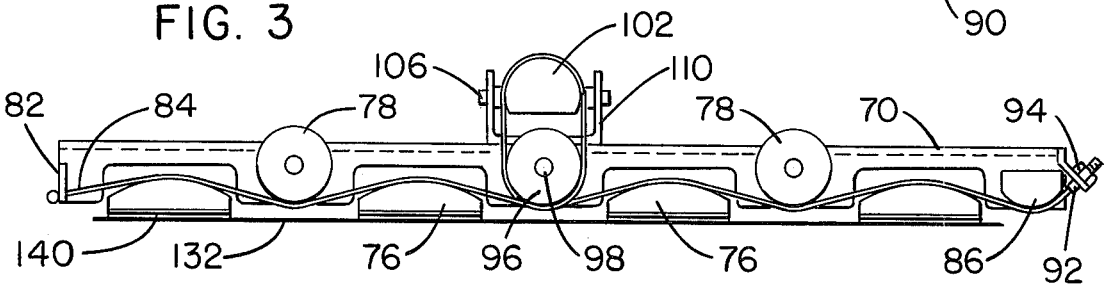
FIG. 3 is a top plan view of the paper clamping mechanism.

FIG. 3 shows a plan view of the clamp members 76, the bearing members or pulleys 78 therebetween, a split pulley 96 journaled on a pin 98 supported from an angle bracket 100 (see also FIG. 4) and a solenoid actuated cable tension control member in the form of a modified pulley 102 supported from a rocker arm 104 pivoted on a pin 106. A solenoid 108 is supported from and secured to the angle bracket 100 and an upstanding U-shaped member 110 by means of nuts 112 and 114 on appropriate bolts, the pin 106 providing the pivot for the rocker arm 104 in the member 110. The solenoid 108 has a plunger 116, loaded by a spring 118, the plunger operating against a portion 120 of the rocker arm 104 to swing the tension control member 102 in a path away from the split pulley 96.

Figure 4:
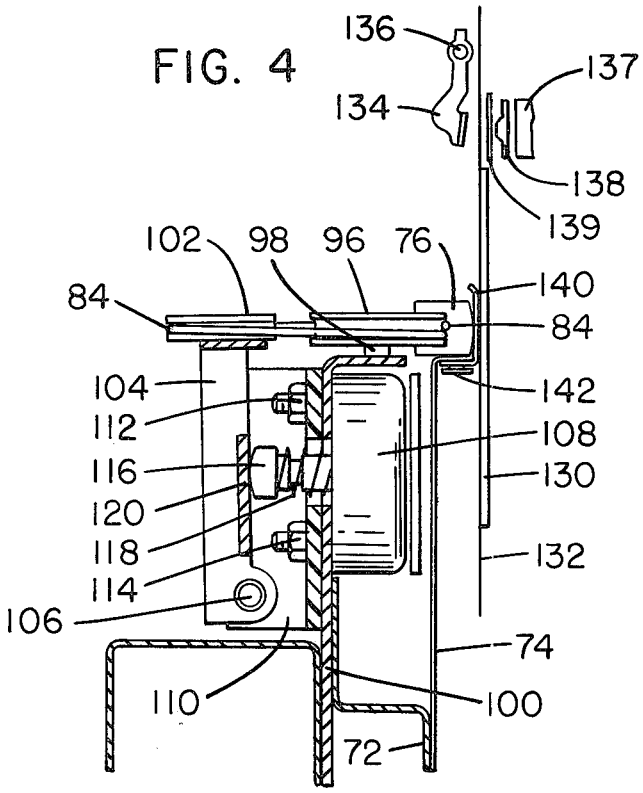
FIG. 4 is an enlarged view in side elevation showing the structure of the present invention.

It is seen from FIG. 4 that the split pulley 96 is, in effect, a double pulley with adjacent flanges removed therefrom, but providing curved surfaces or grooves for the cable 84 to be trained in a path from one clamp member 76 on the left side of and adjacent the split or double pulley 96 and along a portion of an upper groove or curved surface in the double pulley, around the tension control member 102 and along a portion of a lower groove or curved surface in the double pulley 96, and to the clamp member 76 positioned on the other side of the double pulley from the first-mentioned clamp member. An outer throat plate 130 provides a path for the paper 132 past the clamp members 76 and the print station, in which a limited showing thereof includes a hammer 134 pivoted at 136 and impacting against characters on a type character carrying band 138 backed by a platen or like member 137. A ribbon 139 is positioned to operate along the print station between the paper 132 and the band 138.

Figure 5:
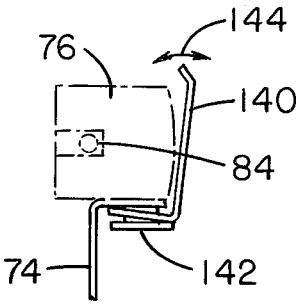
FIG. 5 is an enlarged side view of one of the clamping members.

As seen in FIG. 5, a clamp face member 140 is loosely supported from a pin 142 on the bottom of each clamp member 76 to allow the face member to swivel a small amount, as shown by the arrow 144, to provide a clamp surface which conforms to the surface of the outer throat plate 130.

In FIG. 6 is shown a curve of the solenoid drive as related to current in amperes and to time in milliseconds, wherein armature closure occurs approximately five milliseconds after the end of the forms advance portion of the cycle of printer operation. The time to print one line is approximately ten milliseconds after which the paper is advanced to the next line, such advancement time being approximately 15 milliseconds.

In the operation of the paper clamping mechanism, the cable 84 is installed and tensioned partially around the bearing members or reaction pulleys 78, around the split or double pulley 96, around the solenoid controlled tension control pulley 102, and engaged with the clamp members 76 to provide a tension of 0.2 pounds of clamping force on each clamp 76 by reason of the spring 118 (FIG. 4) biasing the plunger 116 against the portion 120 of the rocker arm 104 to urge the solenoid controlled tension pulley 102 in a direction away from the split pulley 96. In this manner, the system is designed so that the clamp members 76 are always held against or engaged with the paper 132 with a low level cable tension. When the solenoid 108 is energized or actuated, the plunger 116 is extended to the left in FIG. 4 which causes the rocker arm 104 with its pulley 102 to swing or shift away from the split pulley 96 and thereby provide greater tension in the cable 84 wherein the level of clamping force of each clamp member 76 is increased from 0.2 pounds to approximately four pounds to hold the paper 132 in precise position at the time of impact of the hammer 134 against such paper and against the type character carrying band 138. It is thus understood, as illustrated in FIGS. 3 and 4, that there is no clamp motion resulting in a movable impact of the clamp members 76 against the paper 132, but rather provides a squeezing effect on the paper as the mechanism increases the level of the clamping force. The pulleys 78 are movable in limited rotational manner, as is the pulley 96, whereas the pulley 102 is movable in a swingable manner only through rocking of the arm 104 on the pivot 106. It is of course obvious that such pulley 102, if not in the present modified form, may likewise be mounted for rotational movement if so desired without affecting appreciably the overall operation between the various elements.

In FIG. 7 is shown a modification of the invention, which modification is a preferred form of the invention and has certain advantages over the use of the pulleys 78 shown in FIG. 3. The frame member 70 again supports the various elements of the mechanism which include the Z-shaped member 72 (FIG. 2) to which are secured the plurality of upstanding plate members 74 for carrying the respective paper clamp members 76. Interspersed between the clamp members 76 are flexible cable-bearing guide members, generally designated as 150 (one only shown in FIG. 7 toward the left side of the frame member 70, however, there being a like guide member 150 toward the right side of the frame member 70), such flexible members being positioned at the locations on the angle member 80 in place of the pulleys 78 shown in FIG. 3. The flexible members 150 are supported from angular plates 152, see FIG. 8, by means of screws 154 or the like, the plates 152 being secured to the angle member 80. Each of the plates 152 includes a pair of spaced studs 156 for insertion into apertures 158 in the angle member 80.

The flexible guide members 150 are formed of a base portion 160 for securing thereof by the screws 154 or the like to the short leg of the angular plate 152. A flexible arm portion 162 of the member 150 extends outwardly from the base portion 160 and terminates in, or has connected at the end of the arm portion, an arcuate cable-bearing portion 164, the arcuate portion being enlarged and provided with a kerf or groove in the periphery thereof for carrying and seating the cable 84.

In the center of the frame member 70 (toward the right side in FIG. 7) are a pair of flexible guide members, generally designated 170 and 172, the member 170 having a base portion 174 secured by a screw 176 or the like and a pin 178, integral with the portion 174, to the short leg of an angular plate 180. A flexible arm portion 182 of the guide member 170 extends outwardly from the base portion 174 and has connected thereto an arcuate cable-bearing portion 184, the arcuate portion 184 being provided with a cutout in the periphery thereof for seating the cable 84 (as seen in FIG. 9.) In like manner, the guide member 172 has a base portion 186 secured by a screw 188 or the like and a pin 190 to the short leg of the angular plate 180. A flexible arm portion 192 of the member 172 extends outwardly from the base portion 186 and terminates in an arcuate cable-bearing portion 194, the arcuate portion 194 being provided with a cutout in the periphery thereof for the cable 84. As seen in FIG. 9, the peripheral cutouts of the several arcuate portions 184 and 194 face each other and are oppositely disposed for training of the cable 84 in a manner allowing such cable to cross over at the intersection of the arcuate portions 184 and 194. While the angular plate 180 for supporting the two flexible guide members 170 and 172 is quite similar to the angular plate 152 for supporting the flexible guide member 150, in that such plate 180 also includes a pair of studs 196 (only one shown in FIG. 9) for maintaining same secured to the angle member 80, the short leg of the plate 180 also includes, in addition to the tapped holes for the screws 176 and 188, apertures therein for the pins 178 and 190 to accurately position and rigidly secure the members 170 and 172 to the plate 180.

While the construction of the flexible member 150 is relatively simple in the providing of the base portion 160, with the flexible arm portion 162 being an integral part thereof and extending outwardly and normally therefrom in cantilever manner to support the cable-bearing arcuate portion 164, the members 170 and 172 are constructed and supported in a manner wherein the flexible arm portions 182 and 192 extend outwardly at an angle from the base portions 174 and 186 in cantilever manner to support the cable-bearing arcuate portions 184 and 194. As seen in FIGS. 7 and 9, the flexible arm portion 182 of member 170 lies above the flexible arm portion 192 of member 172 in overlapping manner to carry the arcuate portion 184 in a plane immediately above the plane of the arcuate portion 194. It is of course clear that the constructions of the several members 170 and 172 are similar but include certain portions oppositely disposed to provide for the required overlapping of the flexible arm portions 182 and 192.

While the operation of the clamping mechanism has been described above in relation to the use of the bearing members or reaction pulleys 78 and of the double pulley 96 (per FIGS. 2, 3 and 4), wherein actuation of the solenoid 108 rocks tension control member 102 and causes tightening of the cable 84 around a bearing surface of the pulleys, such tightening of the cable causes slight rotation of the pulleys to varying degrees.

In the case of the flexible members being substituted for such pulleys (per FIGS. 7, 8 and 9), when the solenoid 108 is actuated, the rocker arm 104 is caused to pivot and through tension control member 102 thereby tighten the cable 84 along its path past the clamp members 76 and around the arcuate portions or cable-bearing surfaces of the several flexible guide members 150, 170 and 172. The tightening of the cable on the flexible member arcuate portions causes a slight movement or swinging thereof, such movement or swinging being permitted and controlled in part by the force applied on the cable 84 and also by the relative flexibility of the arm portion 162 of member 150, of the arm portion 182 of member 170, and of the arm portion 192 of member 172. The several flexible guide members 150, 170 and 172 are preferably made of a plastic material suitable for the application. In regard to the amount of movement or swinging of the several flexible guide members, the arcuate portions 184 and 194 of the center guide members 170 and 172 move or swing approximately 0.030 of an inch whereas the arcuate portions 164 of the guide members 150 on either side of the central guide members move or swing approximately 0.015 of an inch. In this regard, the cable 84, in effect, stays in place on the peripheral surface of the respective arcuate portions and such portions are permitted to move or swing a slight amount by reason of the flexing of the interconnected arm portions. Similarly, the cable 84 around the pulleys 78 and 96 also stays in place on the peripheries thereof, with the tightening of the cable causing a slight rotation of the several pulleys.

It is thus seen that herein shown and described is clamping apparatus for record media or form paper to hold the paper in a precise position while impacting the paper during printing operations. The mechanism enables the accomplishment of the objects and advantages mentioned above and while more than one embodiment has been disclosed herein, other variations thereof may occur to those skilled in the art. It is contemplated that all such variations, not departing from the spirit and scope of the invention hereof, are to be construed in accordance with the following claims.

What is claimed is:

1. Apparatus for holding record media in precise position while performing recording operations thereon comprising a plurality of clamping members spaced from each other and aligned across the width of said record media adjacent at least one side of said record media and in contact therewith, a plurality of bearing elements intermediate said clamping members, a tension control member, a flexible member in tension trained in a path around said tension control member and engaged with said bearing elements and against said clamping members and secured at the ends thereof, and a solenoid energizable to move said tension control member for tightening said flexible member on said bearing elements and against said clamping members thereby increasing the force of said clamping members against said record media.

2. The apparatus of claim 1 wherein said bearing elements comprise a plurality of pulleys aligned with said clamping members.

3. The apparatus of claim 1 wherein said clamping members comprise a plurality of block members and said bearing elements comprise a plurality of pulleys positioned between said block members, the tightening of said flexible member causing an increase in the clamping force of said block members against said record media.

4. The apparatus of claim 1 wherein said bearing elements comprise a plurality of arcuate guide elements aligned with said clamping members.

5. The apparatus of claim 1 wherein said clamping members comprise a plurality of block members and said bearing elements comprise a plurality of arcuate guide members positioned between said block members, the tightening of said flexible member causing an increase in the clamping force of said block members against said record media.

6. In a printer having means for moving record media past a line of printing, and means for holding the record media in precise position at the time of printing thereon, comprising a plurality of clamping members spaced one from another in aligned manner across the width of said record media and in contact therewith, a tension control member, a flexible member in tension and spanning the width of said record media and secured at one end thereof and engageable with said clamping members and trained about said tension control member and secured at the other end thereof, and solenoid means for moving said tension control member to thereby tighten said flexible member and increase the force of said clamping members against said record media.

7. In the printer of claim 6 wherein said tension control member comprises a pulley spaced from said clamping members in aligned manner.

8. In the printer of claim 6 wherein said clamping members comprise a plurality of block members and said tension control member comprises a pulley positioned adjacent said block members, said pulley being pivotally supported and swingable under control of said solenoid means for tightening said flexible member along said block members.

9. In the printer of claim 6 including a plurality of pulleys interspersed with said clamping members and engageable by said flexible members.

10. In the printer of claim 6 including a plurality of arcuate guide elements interspersed with said clamping members and engageable by said flexible members.

11. A printer comprising a movable type carrier, hammer means for impacting against the type on said carrier, means for moving said carrier to present type along a line of printing, means for moving record media in a path past said printing line, and means for holding said record media at rest while impacting said type thereagainst by said hammer means, including a plurality of clamping block members aligned with each other and disposed adjacent one side of said record media and in contact therewith, tension control means including a rocker member adjacent said clamping members, a flexible cable in tension and assuming a path of engagement with said clamping members and trained about said tension control rocker member, and solenoid means for swinging said tension control rocker member in a direction away from said record media to straighten said flexible member and thereby increase the force of said clamping members against said record media.

12. The printer of claim 11 wherein said tension control means comprises a shiftable pulley aligned on a plane with said clamping members.

13. The printer of claim 11 including a plurality of pulleys interspersed with said clamping members and engageable by said flexible member.

14. The printer of claim 11 including a plurality of arcuate guide elements interspersed with said clamping members and engageable by said flexible member.

15. The printer of claim 11 wherein said tension control means is mounted for rocking movement by actuation of said solenoid means, and said printer includes a plurality of rotatable members aligned with said clamping members for guiding said flexible member.

16. The printer of claim 11 wherein said tension control means is mounted for rocking movement by actuation of said solenoid means, and said printer includes a plurality of arcuate members aligned with said clamping members for guiding said flexible member.

17. Apparatus for holding record media in precise position while performing recording operations thereon comprising a plurality of clamping members spaced across said record media and positioned adjacent one side of said record media and in contact therewith, a tension control member, a flexible cable secured at the ends thereof and trained in a path engaged with said clamping members and with said tension control member, and solenoid actuating means energizable to move said control member in a direction away from said clamping members for tightening said flexible member thereby increasing the force of said clamping members against said record media.

* * * * *